US011078444B2

(12) United States Patent
Burgess et al.

(10) Patent No.: US 11,078,444 B2
(45) Date of Patent: Aug. 3, 2021

(54) LAUNDRY COMPOSITION

(71) Applicant: Conopco, Inc., Englewood Cliffs, NJ (US)

(72) Inventors: Karl Burgess, Wirral (GB); Shaun Charles Walsh, Cheadle (GB)

(73) Assignee: Conopco, Inc., Englewood Cliffs, NJ (US)

( * ) Notice: Subject to any disclaimer, the term of this patent is extended or adjusted under 35 U.S.C. 154(b) by 15 days.

(21) Appl. No.: 16/634,694

(22) PCT Filed: Jul. 23, 2018

(86) PCT No.: PCT/EP2018/069880
§ 371 (c)(1),
(2) Date: Jan. 28, 2020

(87) PCT Pub. No.: WO2019/025216
PCT Pub. Date: Feb. 7, 2019

(65) Prior Publication Data

US 2020/0224126 A1 Jul. 16, 2020

(30) Foreign Application Priority Data

Aug. 2, 2017 (EP) ..... 17184412

(51) Int. Cl.

| | |
|---|---|
| ***C11D 1/72*** | (2006.01) |
| ***C11D 3/37*** | (2006.01) |
| ***C11D 3/50*** | (2006.01) |
| ***B08B 3/04*** | (2006.01) |
| ***C11D 3/22*** | (2006.01) |

(52) U.S. Cl.
CPC ..... *C11D 3/3707* (2013.01); *C11D 1/72* (2013.01); *C11D 3/222* (2013.01); *C11D 3/50* (2013.01)

(58) Field of Classification Search
CPC ..... C11D 1/72; C11D 3/2041; C11D 3/22; C11D 3/3707; C11D 3/50; C11D 3/505; B08B 3/04
See application file for complete search history.

(56) References Cited

U.S. PATENT DOCUMENTS

| | | | |
|---|---|---|---|
| 6,025,319 | A | 2/2000 | Surutzidis et al. |
| 2009/0042766 | A1 | 2/2009 | Mayer et al. |
| 2009/0209661 | A1 | 8/2009 | Somerville Roberts et al. |
| 2012/0165239 | A1 | 6/2012 | Dreja et al. |

FOREIGN PATENT DOCUMENTS

| | | | | |
|---|---|---|---|---|
| JP | 55147597 | | 11/1980 | |
| WO | WO2018129028 | | 10/2008 | |
| WO | WO2016081006 | | 5/2016 | |
| WO | WO 2016/099852 | * | 6/2016 | ..... C11D 3/22 |
| WO | WO2016099852 | | 6/2016 | |
| WO | WO2017125235 | | 7/2017 | |

OTHER PUBLICATIONS

IPRP2 for PCTEP2018070065; Jul. 26, 2019.
Armstrong N A et al.; Drug Development and Industrial Pharmacy the Compressional Properties of Dextrose Mnohydrate and Anhydrous Dextrose of Varying Water Contents; Drug Development and Industrial Pharmacy; Jan. 1, 1986; pp. 1885-1901; XP000946602; vol. 12, No. 11-13.
Search Report and Written Opinion in PCTEP2018069880; Sep. 21, 2018.
Search Report and Written Opinion in EP17184412; Feb. 9, 2018.
Search Report and Written Opinion in EP17184420; Feb. 12, 2018.
Search Report and Written Opinion in PCTEP2018070065; Oct. 5, 2018.

* cited by examiner

*Primary Examiner* — Brian P Mruk
(74) *Attorney, Agent, or Firm* — Greenberg Traurig, LLP

(57) ABSTRACT

A composition comprising a plurality of particles, wherein said particles comprise: a) 10 to 60 w.t. % polyethylene glycol, wherein the polyethylene glycol has a weight average molecular weight from 4000 to 12000; b) 0.1 to 50 w.t. % polysaccharide; c) 0.1 to 50 w.t. % ethoxylated non-ionic surfactant having a general formula: $R_1O(R_2O)xH$ $R_1$=a saturated fatty alcohol or polypropylene glycol. $R_2$=$C_2H_4$ or mixture of $C_2H_4$ and $C_3H_6$x=8 to 120 and having a melting point between 40 and 60° C.; and d) 0.1 to 30 w.t. % perfume materials.

15 Claims, No Drawings

LAUNDRY COMPOSITION

FIELD OF THE INVENTION

Perfume particles for laundry.

BACKGROUND OF THE INVENTION

Fragrance is an important aspect of the laundry process. Consumers often associate fragrance with cleanliness or simply enjoy the smell; accordingly, many laundry products comprise perfumes. However, the desired quantity of perfume varies from consumer to consumer. Consequently perfume particles have been developed to allow consumers to tailor their perfume experience based on their person preferences.

WO 2016/099852 discloses a composition of a plurality of homogeneously structured particles. The particles include polyethylene glycol, perfume, and starch granules and each has a mass between about 0.95 mg and about 5 grams.

A technical problem has been identified with the stability of particles comprising starch. The particles comprising starch, particularly those in open containers, undergo a change in their composition or structure over time. This change is particularly evident in particles comprising colourants, wherein the particles exhibit uneven colouration over time. There is a need to improve the stability of laundry perfume particles.

SUMMARY OF THE INVENTION

A composition comprising a plurality of particles, wherein said particles comprise:

a) 10 to 60 w.t. % polyethylene glycol, wherein the polyethylene glycol has a weight average molecular weight from 4000 to 12000;

b) 0.1 to 50 w.t. % polysaccharide;

c) 0.1 to 50 w.t. % ethoxylated non-ionic surfactant having a general formula:

$$R_1O(R_2O)xH$$

$R_1$=a saturated fatty alcohol or polypropylene glycol.

$R_2$=$C_2H_4$ or mixture of $C_2H_4$ and $C_3$ and $H_6$ units x=8 to 120 and having a melting point between 40 and 60° C.; and d) 0.1 to 30 w.t. % perfume materials.

The invention is also concerned with use of the particles to impart fragrance to laundered fabrics.

DETAILED DESCRIPTION OF THE INVENTION

These and other aspects, features and advantages will become apparent to those of ordinary skill in the art from a reading of the following detailed description and the appended claims. For the avoidance of doubt, any feature of one aspect of the present invention may be utilised in any other aspect of the invention. The word "comprising" is intended to mean "including" but not necessarily "consisting of" or "composed of." In other words, the listed steps or options need not be exhaustive. It is noted that the examples given in the description below are intended to clarify the invention and are not intended to limit the invention to those examples per se. Similarly, all percentages are weight/weight percentages unless otherwise indicated. Except in the operating and comparative examples, or where otherwise explicitly indicated, all numbers in this description indicating amounts of material or conditions of reaction, physical properties of materials and/or use are to be understood as modified by the word "about". Numerical ranges expressed in the format "from x to y" are understood to include x and y. When for a specific feature multiple preferred ranges are described in the format "from x to y", it is understood that all ranges combining the different endpoints are also contemplated.

Polyethylene Glycol

Polyethylene Glycol (PEG) comes in various weight average molecular weights. A suitable weight average molecular weight of PEG for the purposes of the present invention includes from 4,000 to 12,000, preferably 5,000 to 11,000, more preferably 6,000 to 10,000 and most preferably 7,000 to 9,000. Suitable PEG is available under trade names Polyglycol 8000 ex Clariant and Pluriol 8000 ex BASF.

The particles of the present invention comprise 10 to 60 w.t. % PEG, preferably 20 to 50 w.t. % PEG, most preferably 25 to 45 w.t. % PEG.

The PEG can have a PEG perfume load level. The PEG perfume load level is the ratio of the mass of perfume in the PEG to the mass of PEG alone. To promote release of perfume, it can be desirable for the PEG perfume load level to be greater than the glucose perfume load level. The PEG perfume load level can be measured and compared to the glucose load level by 1) heating a sample of the particles according to the present invention above their melting point, 2) centrifuging the sample to separate the molten PEG phase from the starch and ethoxylated non-ionic surfactant, 3) removing an equal weight portion of both phases, 4) diluting each phase with suitable level of methanol to enable measuring of the relative perfume level of each material via standard gas chromatography and mass spectrometer techniques.

Polysaccharide

Polysacharides are polymers of monosaccharides. Preferably, the polyscharide comprises 100 to 3000 monosaccharide units, more preferably 200 to 2000 monosacharide units, most preferably 300 to 1500 units.

Monosaccharides are simple sugar units having the general formula $(CH_2O)_n$. Commonly n is 3, 5 or 6. According, monosaccharides can be classified by the number n, for example: trioses (e.g. glyceraldehyde), pentoses (e.g. ribose) and hexoses (e.g. fructose, glucose and galactose). Some monosaccharides may be substituted with additional functional groups, e.g. Glucosamine, others may have undergone deoxgenation and lost an oxygen atom e.g. deoxyribose. Therefore the general chemical formulae can vary slightly depending on the monosaccharide.

Polysaccharides are defined not only by the monomer units in the polymer chain, but also by the structure of the polymer chain. For example Starch, Glycogen and Cellulose are all glucose polymers, but all have different structures and different properties. Whereas Xanthan gum is an example of a glucose polymer back bone with side chains comprising other monosaccharides.

Starch is generally a naturally occurring polysaccharide, however may be artificially synthesised. Starch granules comprise amylose (unbranched polymer of α-glucose) and amylopectin (branched polymer of α-glycose. Depending on the source of the starch, the relative amounts of amylose and amylopectin can vary. Examples of natural sources of starch include: wheat, corn, potato, rice, and cassava.

Glycogen has a similar structure to amylopectin, however is more branched.

Cellulose is an unbranched polymer of β-glycose. Cellulose can form hydrogen bonds between adjacent cellulose chains.

Xanthan gum is a hetero-polysaccharide comprising a glucose main chain and a side chain comprising mannose and glucuronic acid.

Other non-limiting examples of polysaccharides include: galactomannans such as guar gum, chitin, chitosan, gum arabic, gellan gum carrageenan and pectin.

It is preferred that the polysaccharide of the present invention comprises glucose units, more preferably, the polysaccharide of the present invention comprise only glucose units. Preferably, the polysaccharide of the present invention comprises starch, more preferably, the polysaccharide of the present invention is starch. Preferably, the starch has a grain size 1 um-200 um.

The particles of the present invention comprises 0.1 to 50 w.t. % polysaccharide, preferably 1 to 40 w.t. % polysaccharide, most preferably 10 to 40 w.t. % polysaccharide.

Ethoxylated Non-Ionic Surfactant

The present invention comprises an ethoxylated non-ionic surfactant having a general formula:

$$R_1O(R_2O)xH$$

$R_1$=a saturated fatty alcohol or polypropylene glycol.

$R_2$=$C_2H_4$ or mixture of $C_2H_4$ and $C_3H_6$ units x=8 to 120 and having a melting point between 40 and 60° C.

Preferably, the melting point is between 45 and 60° C. and most preferably between 50 and 60° C. The melting point of the ethoxylated non-ionic surfactant is determined by the dropping point, i.e. when the ethoxylated non-ionic surfactant passes to liquid state and is significantly fluid to drip. This may be measured using the German Institute for Standardisation test method DIN51801-2.

$R_1$ preferably comprises 12 to 20 carbon atoms and mixtures thereof, more preferably 12 to 18 carbon atoms and mixtures thereof most preferably 16 to 18 carbon atoms and mixtures thereof. Preferably, $R_1$ is a saturated fatty alcohol.

$R_2$ preferably comprises at least 50% $C_2H_4$, more preferably 75% $C_2H_4$, most preferably $R_2$ is $C_2H_4$.

X is preferably 25 to 90 and most preferably 45 to 85.

The particles of the present invention comprises 0.1 to 50 w.t. % ethoxylated non-ionic surfactant, preferably 10 to 40 w.t. % ethoxylated non-ionic surfactant, most preferably 15 to 35 w.t.')/0 ethoxylated non-ionic surfactant.

Particularly preferably the ethoxylated non-ionic surfactant is an ethoxylated alcohol having a general formula:

$$RO(C_2H_4O)xH$$

R=a saturated fatty alcohol x=8 to 120 and having a melting point between 40 and 60° C.

The saturated fatty alcohol of the ethoxylated alcohol is preferably a linear saturated fatty alcohol. Preferably the fatty alcohol is selected from: linear C12 to C20 fatty alcohols and mixtures thereof, more preferably the fatty alcohol is selected form: linear C16 fatty alcohol, linear C18 fatty alcohol, linear C12-C16 mixed fatty alcohol and linear C16-C18 mixed fatty alcohol. Most preferably, the linear fatty alcohol is a linear C16-C18 mixed fatty alcohol.

The degree of ethoxylation of the ethoxylated alcohol is preferably 8 to 120, more preferably 25 to 90 and most preferably 45 to 85.

An important feature of the ethoxylated alcohols of the present invention is their melting point. The melting point of the ethoxylated alcohols of the present invention is between 40 and 60° C., preferably between 45 and 60° C. and most preferably between 50 and 60° C. Melting point may be measured using the German Institute for Standardisation test method DIN51801-2.

The particles of the present invention comprises 0.1 to 50 w.t. % ethoxylated alcohol, preferably 10 to 40 w.t. % ethoxylated alcohol, most preferably 15 to 35 w.t. % ethoxylated alcohol.

Examples of suitable materials include Lutensol AT 50 and Lutensol AT 80 ex. BASF.

Perfume

The particles of the present invention comprises 0.1 to 30 w.t. % perfume materials, i.e. free perfume and/or perfume microcapsules. As is known in the art, free perfumes and perfume microcapsules provide the consumer with perfume hits at different points during the wash cycle. It is particularly preferred that the particles of the present invention comprise a combination of both free perfume and perfume microcapsules.

Preferably the particles of the present invention comprises 0.5 to 20 w.t. % perfume materials, more preferably 1 to 15 w.t. % perfume materials, most preferably 2 to 10 w.t. % perfume materials.

Useful perfume components may include materials of both natural and synthetic origin. They include single compounds and mixtures. Specific examples of such components may be found in the current literature, e.g., in Fenaroli's Handbook of Flavor Ingredients, 1975, CRC Press; Synthetic Food Adjuncts, 1947 by M. B. Jacobs, edited by Van Nostrand; or Perfume and Flavor Chemicals by S. Arctander 1969, Montclair, N.J. (USA). These substances are well known to the person skilled in the art of perfuming, flavouring, and/or aromatizing consumer products.

Free Perfumes:

The particles of the present invention preferably comprises 0.1 to 15 w.t. % free perfume, more preferably 0.5 to 8 w.t. % free perfume.

Particularly preferred perfume components are blooming perfume components and substantive perfume components. Blooming perfume components are defined by a boiling point less than 250° C. and a Log P or greater than 2.5. Substantive perfume components are defined by a boiling point greater than 250° C. and a Log P greater than 2.5. Boiling point is measured at standard pressure (760 mm Hg). Preferably, a perfume composition will comprise a mixture of blooming and substantive perfume components. The perfume composition may comprise other perfume components.

It is commonplace for a plurality of perfume components to be present in a free oil perfume composition. In the compositions for use in the present invention it is envisaged that there will be three or more, preferably four or more, more preferably five or more, most preferably six or more different perfume components. An upper limit of 300 perfume components may be applied.

Perfume Microcapsules:

The particles of the present invention preferably comprises 0.1 to 15 w.t. % perfume microcapsules, more preferably 0.5 to 8 w.t. % perfume microcapsules. The weight of microcapsules is of the material as supplied.

When perfume components are encapsulated, suitable encapsulating materials, may comprise, but are not limited to; aminoplasts, proteins, polyurethanes, polyacrylates, polymethacrylates, polysaccharides, polyamides, polyolefins, gums, silicones, lipids, modified cellulose, polyphosphate, polystyrene, polyesters or combinations thereof.

Particularly preferred materials are aminoplast microcapsules, such as melamine formaldehyde or urea formaldehyde microcapsules.

Perfume microcapsules of the present invention can be friable microcapsules and/or moisture activated microcapsules. By friable, it is meant that the perfume microcapsule will rupture when a force is exerted. By moisture activated, it is meant that the perfume is released in the presence of water. The particles of the present invention preferably comprises friable microcapsules. Moisture activated microcapsules may additionally be present. Examples of a microcapsules which can be friable include aminoplast microcapsules.

Perfume components contained in a microcapsule may comprise odiferous materials and/or pro-fragrance materials.

Particularly preferred perfume components contained in a microcapsule are blooming perfume components and substantive perfume components. Blooming perfume components are defined by a boiling point less than 250° C. and a Log P greater than 2.5. Substantive perfume components are defined by a boiling point greater than 250° C. and a Log P greater than 2.5. Boiling point is measured at standard pressure (760 mm Hg). Preferably a perfume composition will comprise a mixture of blooming and substantive perfume components. The perfume composition may comprise other perfume components.

It is commonplace for a plurality of perfume components to be present in a microcapsule. In the compositions for use in the present invention it is envisaged that there will be three or more, preferably four or more, more preferably five or more, most preferably six or more different perfume components in a microcapsule. An upper limit of 300 perfume components may be applied.

The microcapsules may comprise perfume components and a carrier for the perfume ingredients, such as zeolites or cyclodextrins.

Colourant

The particles of the present invention preferably comprise a colourant. The colourant may be a dye or a pigment or a mixture thereof. The colourant has the purpose to impart colour to the particles, it is not intended to be a shading dye or to impart colour to the laundered fabrics. A single colourant or a mixture of colourants may be used.

Preferably, the colourant is a dye, more preferably a polymeric dye. Non-limiting examples of suitable dyes include the LIQUITINET range of dyes ex Milliken Chemical. Preferably the particles of the present invention comprise 0.001 to 2 w.t. %, more preferably 0.005 to 1 w.t. %, most preferably 0.01 to 0.6 w.t. %.

Additional Benefit Agents

The particles of the present invention comprise perfume as a primary benefit agent. However, it may be desirable for the particles of the present invention to deliver more than one benefit agent to laundered fabrics. Additional benefit agents may be free in the carrier material i.e. the PEG, or they may be encapsulated. Suitable encapsulating materials are outlined above in relation to perfumes.

a) malodour agents for example: uncomplexed cyclodextrin; odor blockers; reactive aldehydes; flavanoids; zeolites; activated carbon; and mixtures thereof
b) dye transfer inhibitors
c) shading dyes
d) silicone oils, resins, and modifications thereof such as linear and cyclic polydimethylsiloxanes, amino-modified, allcyl, aryl, and alkylaryl silicone oils, which preferably have a viscosity of greater than 50,000 cst;
e) insect repellents
f) organic sunscreen actives, for example, octylmethoxy cinnamate;
g) antimicrobial agents, for example, 2-hydroxy-4,2,4-trichlorodiphenylether;
h) ester solvents; for example, isopropyl myristate;
i) lipids and lipid like substance, for example, cholesterol;
j) hydrocarbons such as paraffins, petrolatum, and mineral oil
k) fish and vegetable oils;
l) hydrophobic plant extracts;
m) waxes;
n) pigments including inorganic compounds with hydrophobically-modified surface and/or dispersed in an oil or a hydrophobic liquid, and;
o) sugar-esters, such as sucrose polyester (SPE).

Additional Ingredients

The particles of the present invention may comprises 0.1 to 10 w.t. % additional carrier material (in addition to the PEG). Examples of additional materials include clays, polysaccharides, glycerine, isopropyl myristate, dipropylene glycol, 1,2 propanediol, polypropylene glycol, PEG having an average molecular weight range of less than 2000 and mixtures thereof.

Laundry Actives

The particles of the present invention have the purpose of providing fragrance, the primary function is not softening or cleaning. The particles of the present invention are preferably substantially free of laundry and softening actives, other than the ethoxylated non-ionic surfactant. By substantially free, it is meant 0 to 3 w.t. % of softening or cleaning actives, preferably 0 to 2 w.t. %, more preferably 0 to 1 w.t. % of the particle composition. Softening and cleaning agents are well known in the art, examples of which include: detergent surfactants, detergent builders, bleaching agents, enzymes, and quaternary ammonium compounds. A low level of non-detersive surfactant may be present in the perfume and/or benefit agent compositions which may be present in the particles of the present invention.

Form of Particles

The particles of the present invention may be in any solid form, for example: powder, pellet, tablet, prill, pastille or extrudate. Preferably the particles are in the form of a pastille. Pastilles can, for example, be produced using ROTOFORMER Granulation Systems ex. Sandvick Materials.

The particles may be any shape or size suitable for dissolution in the laundry process. Preferably, each individual particle has a mass of between 0.95 mg to 5 grams, more preferably 0.01 to 1 gram and most preferably 0.02 to 0.5 grams. Preferably each individual particle has a maximum linear dimension in any direction of 10 mm, more preferably 1-8 mm and most preferably a maximum linear dimension of 4-6 mm. The shape of the particles may be selected for example from spherical, hemispherical, compressed hemispherical, lentil shaped, oblong, or planar shapes such as petals. A preferred shape for the particles is hemispherical, i.e. a dome shaped wherein the height of the dome is less than the radius of the base. When the particles are compressed hemispherical, it is preferred that diameter of the substantially flat base provides the maximum linear dimension and the height of the particle is 1-5 mm, more preferably 2-3 mm. the dimensions of the particles of the present invention can be measured using Calipers.

The particles of the present invention can be formed from a melt comprising the ingredients, as outlined in the examples. The melt can, for example, be formed into particles by: Pastillation e.g. using a ROTOFORMER ex Sandvick Materials, extrusion, prilling, by using moulds, casting the melt and cutting to size or spraying the melt.

The particles of the present invention are preferably homogeneously structured. By homogeneous, it is meant that there is a continuous phase throughout the particle. There is not a core and shell type structure. Particles such as perfume microcapsules will be distributed within the continuous phase.

Method of Use

The particles of the present invention are for use in the laundry process. They may be added in the wash phase, second phase or a rinse phase of a wash cycle using a washing machine. Alternatively the particles may be used in manual hand washing of fabrics. The particles may be used in addition to other laundry products or they may be used as a standalone product.

The particles of the present invention are preferably dosed in a quantity of 1 g to 50 g, more preferably 10 g to 45 g, most preferably 15 g to 40 g.

Use for the Particles

The primary use of the particles of the present invention is to impart fragrance to laundered fabrics. The fragrance is imparted during the laundry process. The particles may be further used to deliver additional benefit agents to fabrics during the laundry process.

EXAMPLES

| | Comparative A | Example 1 | Example 2 |
|---|---|---|---|
| PEG 8000[1] | 65 | 35 | 35 |
| Starch[2] | 26 | 26 | 36 |
| Ethoxylated alcohol[3] | — | 30 | 20 |
| Blue dye[4] | 0.0165 | 0.0145 | 0.0145 |
| Free perfume | 7 | 6.5 | 6.5 |
| Perfume microcapsules[5] | 2 | 2 | 2 |

PEG 8000[1] - Polyglycol 8000 ex Clariant
Starch[2] - Tapioca C*Creamgel 7001 ex Cargill
Ethoxylated alcohol[3] - Lutensol AT80 ex.BASF
Blue dye[4] - Milliken Liquitint Blue HP
Perfume microcapsules[5] - weight as supplied The slightly difference in levels of dye is to compensate for differences in the colour of Starch and ethoxylated alcohol. This differences allows for an identical colour of freshly manufactured product and therefore ensures an accurate comparison.

Process of Manufacturing Pastilles:

The PEG was heated in a mixing vessel, with stirring, until molten and homogeneous. The starch or ethoxylated alcohol was then slowly added with stirring. Stirring was maintained during the addition of the fragrance, followed by the encapsulated fragrance and finally the dye was added. The mix was then pumped to a ROTOFORMER Model RF 4G ex Sandvick Materials and pastilled. The temperature of the melt material was 53-56° C. and belt temperature of 1-15° C. above local atmospheric dew point. The resulting pastilles were compressed hemispherical, having an average diameter of 4-6 mm.

Observations:

| Description of colour | Comparative A | Example 1 | Example 2 |
|---|---|---|---|
| Fresh batch | Even distribution | Even distribution | Even distribution |
| 24 hours at ambient, stored open to the air | Uneven, a number of pastilles very pale on one side and dark on the other | Uniform appearance | Uniform appearance |

The pastilles comprising ethoxylated alcohol were significantly more stable as demonstrated by lack of colour change.

The invention claimed is:

1. A composition comprising a plurality of particles, wherein said particles comprise:

a. 10 to 60 w.t %, polyethylene glycol, wherein the polyethylene glycol has a weight average molecular weight from 4000 to 12000;

b. 0.1 to 50 w.t % polysaccharide;

c. 0.1 to 50 w.t %, ethoxylated non-ionic surfactant having a general formula:

$$R_1O(R_2O)xH$$

$R_1$=a saturated fatty alcohol or polypropylene glycol
$R_2$=$C_2H_4$ or mixture of $C_2H_4$ and $C_3H_6$ units
x=8 to 120
and having a melting point between 40 and 60° C.; and d. 0.1 to 30 w.t % perfume materials.

2. The composition according to claim 1, wherein the ethoxylated non-ionic surfactant is an ethoxylated alcohol having a general formula:

$$R_1O(R_2O)xH$$

R=a saturated fatty alcohol
x=8 to 120
and having a melting point between 40 and 60° C.

3. The composition according to claim 1, wherein the saturated fatty alcohol is selected from: linear C12 to C20 fatty alcohols and mixtures thereof.

4. The composition according to claim 1, wherein x is 25 to 90.

5. The composition according to claim 1, wherein the polysaccharide comprises glucose units.

6. The composition according to claim 1, wherein the polysaccharide comprises starch.

7. The composition according to claim 1, wherein the composition comprises 0.1 to 15 w.t % free perfume.

8. The composition according to claim 1, wherein the composition comprises 0.1 to 15 w.t % of particle perfume microcapsules.

9. The composition according to claim 1, wherein the perfume materials comprise both free perfume and perfume microcapsules.

10. The composition according to claim 1, wherein the perfume comprise friable perfume microcapsules.

11. The composition according to claim 1, wherein the particles are pastilles.

12. The composition according to claim 1, wherein the particles have a maximum dimension less than 10 mm.

13. The composition according to claim 1, wherein the particles further comprise 0.001 to 2 w.t % colourant.

14. The composition according to claim 1, wherein the particle is homogeneously structured.

15. A method to impart fragrance to a laundered fabric comprising the step of contacting the laundered fabric with a composition comprising particles, the particles comprising:

a. 10 to 60 w.t %, polyethylene glycol, wherein the polyethylene glycol has a weight average molecular weight from 4000 to 12000;

b. 0.1 to 50 w.t % polysaccharide;

c. 0.1 to 50 w.t %, ethoxylated non-ionic surfactant having a general formula:

$$R_1O(R_2O)xH$$

$R_1$=a saturated fatty alcohol or polypropylene glycol $R_2$=$C_2H_4$ or mixture of $C_2H_4$ and $C_3H_6$ units x=8 to 120 and having a melting point between 40 and 60° C.; and d. 0.1 to 30 w.t % perfume materials.

* * * * *